US006892399B1

(12) United States Patent
Rocha

(10) Patent No.: US 6,892,399 B1
(45) Date of Patent: May 17, 2005

(54) WOMENS' PANT'S CONSTRUCTION WITH CROTCH PANEL FOR SLIMMING APPEARANCE OF THIGHS

(76) Inventor: Cristina Rocha, 1533 Maltman Ave., Los Angeles, CA (US) 90026-1019

( * ) Notice: Subject to any disclaimer, the term of this patent is extended or adjusted under 35 U.S.C. 154(b) by 0 days.

(21) Appl. No.: 10/701,952

(22) Filed: Nov. 4, 2003

(51) Int. Cl.[7] ..... A41D 1/06
(52) U.S. Cl. ..... 2/227; 2/234; 2/235
(58) Field of Search ..... 2/227, 228, 238, 2/234, 235, 218, 219, 214, 400, 405, 408, 69–71, 73, 75, 78.1, 78.2, 78.4, 79, 80, 83, 114; 450/102–105, 119, 121, 141, 155, 94, 95, 100, 101, 106, 115, 117

(56) References Cited

U.S. PATENT DOCUMENTS 1,553,863 A * 9/1925 Kraft ..... 2/227
1,661,072 A * 2/1928 Hutchinson ..... 2/405
1,810,517 A * 6/1931 Fink ..... 2/404
4,805,243 A 2/1989 Gibbens et al.
4,961,234 A * 10/1990 Leibman ..... 2/234
RE36,905 E 10/2000 Noble et al.

OTHER PUBLICATIONS

Gershman, M.D; Maurice; "Self–Adhering Nylon Tapes" *Journal of the American Medical Assn.*, vol. 68; No. 7.*

* cited by examiner

*Primary Examiner*—Gloria M. Hale
(74) *Attorney, Agent, or Firm*—Kelly Lowry & Kelley, LLP

(57) ABSTRACT

A garment for slimming and smoothing the appearance of a woman's crotch and thighs includes a pair of pants having a lower torso receiving portion, an upper waistband, two leg portions, an inseam along each leg portion, and a crotch seam between the inseams. A quadrilaterally-shaped crotch panel is disposed forward of the crotch seam and between the inseams. A pants closure means extends generally from the crotch panel to the waistband.

11 Claims, 3 Drawing Sheets

WOMENS' PANT'S CONSTRUCTION WITH CROTCH PANEL FOR SLIMMING APPEARANCE OF THIGHS

BACKGROUND OF THE INVENTION

The invention relates generally to pants. More particularly, the invention relates to pants with a crotch panel for slimming the appearance of a wearer's thighs.

There is a great need for pants that flatter the figure. In a world that values physical appearance, many individuals do what they can to maximize their figure and wear clothing that accentuate and display their bodies. In many instances, however, simple genetics may not allow an individual to wear form fitting clothing despite dieting or exercise. In order to change their appearance, many individuals resort to painful and expensive surgery.

A conventional pair of pants 20 is shown in FIGS. 1 and 2. These pants 20 include leg portions 22, a seat portion 24, a front portion 26, an upper waistband 28 with a closure (not shown), an inseam 30 on each leg portion 22, and a closure member 32 running down the middle of the front portion 26 from the waistband. 28 to a seam 34. The seam 34 runs down the middle of the seat portion 24 from the waistband 28 to the closure member 32.

This seam 34 may result in embarrassment and/or discomfort to a female wearer because the seam 34 runs directly over the female external genitalia. When the seam 34 allows the material of the pants 20 to bunch up or ride up in the area of the female external genitalia, the contours of the wearer's external genitalia may be revealed, causing embarrassment and/or discomfort as the seam 34 presses against and between the external genitalia of the wearer. This can be very painful to a female user, especially if she has a gynecological condition such as a yeast infection, bladder infection, menstruation or the like.

Many different types of pants have been employed to alter or support parts of the lower body. However, such pants may involve parts that need adjustment in order to make the pants function as desired or may be padded in a manner that decreases comfort. For example, U.S. Pat. No. 4,805,243 discloses a padded pant construction for athletic purposes. However, the pant merely pads the crotch area which may make the pants uncomfortable for non-athletic use. In another example, U.S. Pat. No. RE. 36,905 discloses a figure enhancing garment. However, the garment requires a complicated system of pulleys and strings to adjust the pants.

While garments such as those described above may provide means of altering or supporting the lower body, such garments can always be improved.

Accordingly, there is a need for a garment that helps the user attain a slimmer appearance. There is also a need for a garment that is comfortable to wear. There is a further need for a garment that does not bunch up around or otherwise form-fit around the contours of a female wearer's external genitalia. The present invention satisfies these needs and provides other related advantages.

SUMMARY OF THE INVENTION

The present invention discloses an improved women's pants construction with a crotch panel for slimming the appearance of a woman's thighs. The improved garment is comfortable to wear and does not bunch up around or otherwise form-fit around the contours of a female wearer's external genitalia.

A garment for slimming and smoothing the appearance of a woman's crotch and thighs includes a pair of pants having a lower torso receiving portion, an upper waistband, and two leg portions. An inseam is located along each leg portion, and a crotch seam runs between the inseams. A quadrilaterally-shaped crotch panel is disposed forward of the crotch seam and between the inseams.

A pants closure means extends generally from the crotch panel to the waistband. The pants closure means may be in the form of a zipper, a lace-up construction or the like. The pants closure means includes two panels extending from the crotch panel to the waistband.

The waistband also includes a closure.

The crotch panel comes in a variety of constructions including a single panel, two panels sewn together or the like.

At least a portion of the pants is made of a first material and the crotch panel is made of a second material.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
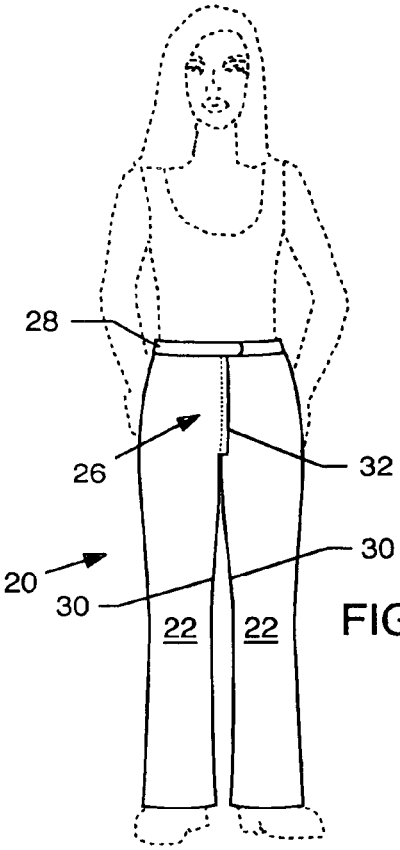
FIGS. 1 and 2 are front and side views of a conventional pair of pants.
Figure 2:
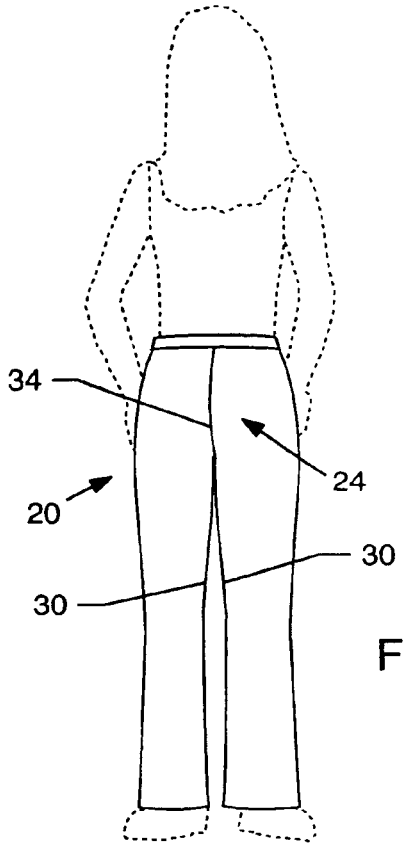
Figure 3:
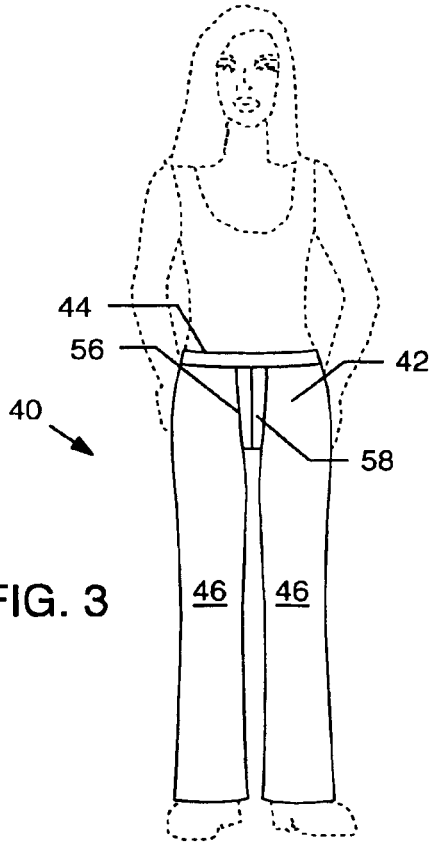
FIGS. 3 and 4 are front and side views of a pair of pants embodying the present invention.
Figure 4:
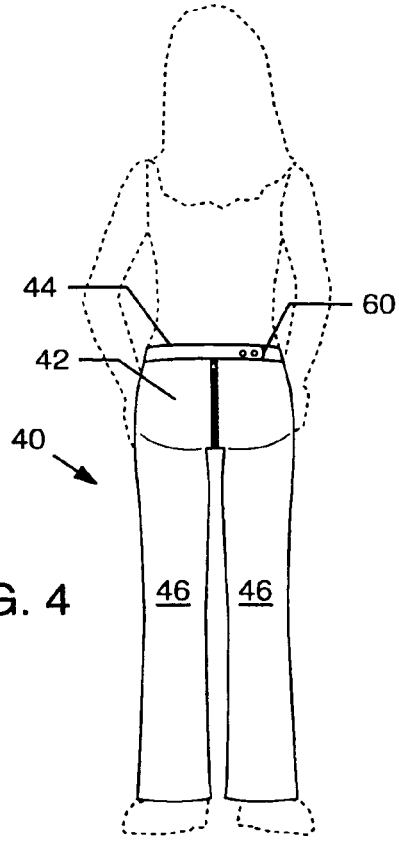
Figure 5:
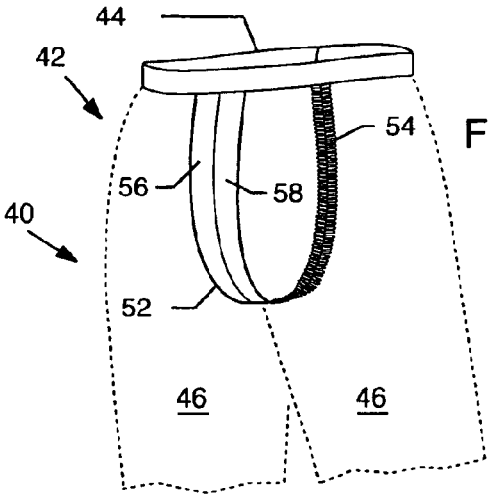
FIG. 5 is an orthogonal view of a pair of pants embodying the present invention.
Figure 6:
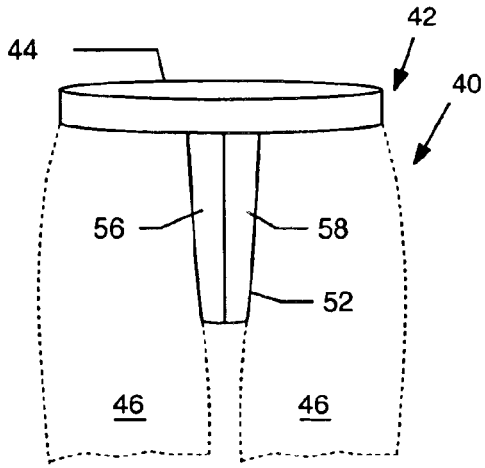
FIG. 6 is a front elevation view of the pants of FIG. 5.
Figure 8:
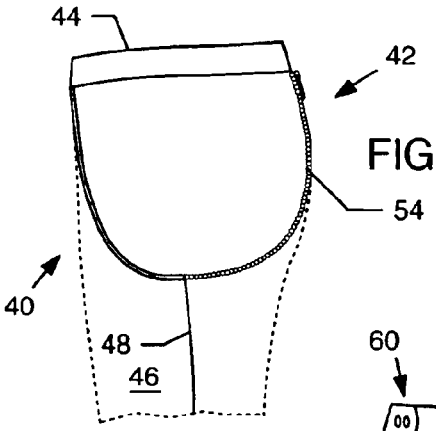
FIG. 8 is a side elevation view of the pants of FIG. 5.
Figure 7:
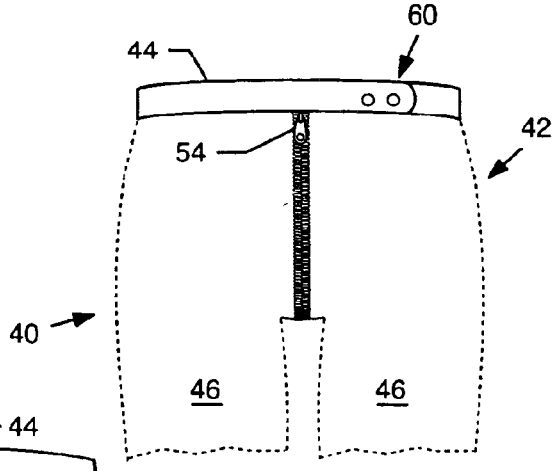
FIG. 7 is a rear elevation view of the pants of FIG. 5.
Figure 9:
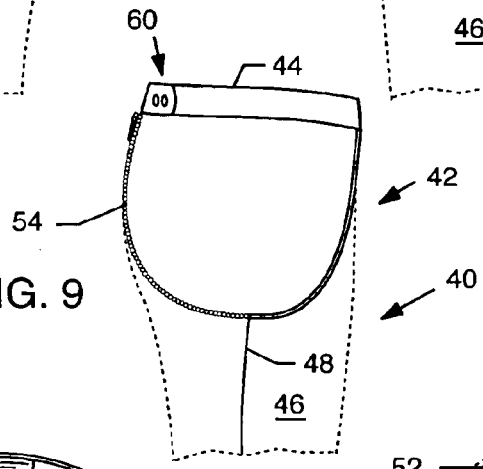
FIG. 9 is another side elevation view of the pants of FIG. 5.
Figure 10:
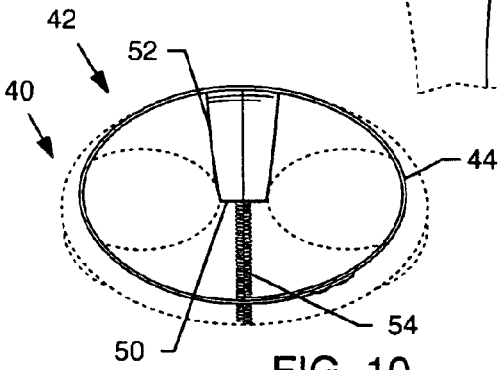
FIG. 10 is a top plan view of the pants of FIG. 5.
Figure 11:
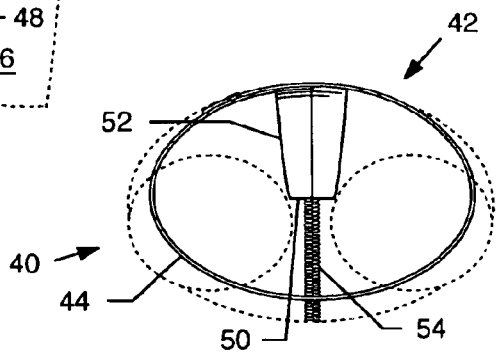
FIG. 11 is a bottom plan view of the pants of FIG. 5.

The present invention is useful in that it provides a woman's pant's construction with a crotch panel that slims the appearance of the wearers thighs. The present invention partially separates the thighs of a user wearing pants embodying the present invention. The present invention also provides a garment that is comfortable to wear and does not bunch up around or otherwise form-fit around the contours of a female wearer's external genitalia.

As shown in the drawings for purposes of illustration, the present invention resides in a garment for slimming and smoothing the appearance of a woman's crotch and thighs.

A particular embodiment of the invention, as shown in FIGS. 1–11, is in the form of a garment for slimming and smoothing the appearance of a woman's crotch and thighs. The garment is in the form of a pair of pants 40 having a lower torso receiving portion 42, an upper waistband 44, and two leg portions 46. The lower torso receiving portion 42 is intended to accommodate the lower torso (i.e., legs, pelvis, crotch, waist, buttocks, etc.) of a user. The upper waistband 44 is intended to encircle the general area of a users waist and the leg portions 46 are intended to receive the user's legs.

An inseam 48 is located along each leg portion 46, and a crotch seam 50 runs between the inseams 48.

A quadrilaterally-shaped crotch panel 52 is disposed forward of the crotch seam 50 and between the inseams 48. The crotch panel 52 is disposed generally over the area of the external female genitalia and presents a smooth surface that does not follow the contours of the external female genitalia.

In order to secure the pants 40 from falling off the user, a pants closure means 54 extends generally from the crotch panel 52 to the waistband 44 along the seat of the pants 40, generally between the buttocks of the user. In this embodiment, the closure means 54 is in the form of a zipper, but, alternatively, the closure means 54 could also include a lace-up construction (i.e., lace and eyelet), snaps (male and female), buttons and button holes, hook and loop fasteners (e.g., VELCRO) or the like.

The crotch panel 52 is in the form of two panels 56, 58 sewn together.

The upper waistband 44 includes a closure 60. The closure 60, as shown, is in the form of two buttons with matching button holes. Alternatively, the closure 60 may also be in the form of a lace-up construction (i.e., laces and eyelets), snaps (male and female), hook and loop fasteners (e.g., VELCRO) or the like. The waistband 44 may be in the form of a partial belt built-into the pants 40.

The pants 40 may be made of a variety of materials including natural fibers (e.g., cotton, wool, etc.), synthetic fibers (nylon, rayon, etc.), leather, plastic, vinyl, any combination of the foregoing or the like. Likewise, the crotch panel 52 may be made of identical and/or similar materials to that of the pants 40. The pants 40 and crotch panel 52 may be made of the same materials or at least a portion of the pants 40 may be made of a first material with the crotch panel 52 made of a second material. The waistband 44 may be made of materials identical and/or similar to the pants 40 or crotch panel 52.

Figure 12:
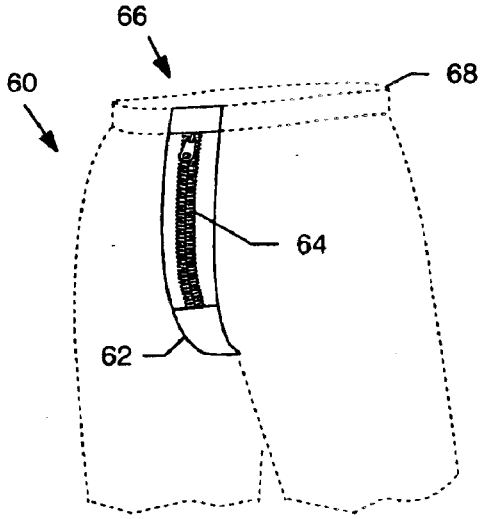
FIG. 12 is an orthogonal view of another pair of pants embodying the present invention.
Figure 13:
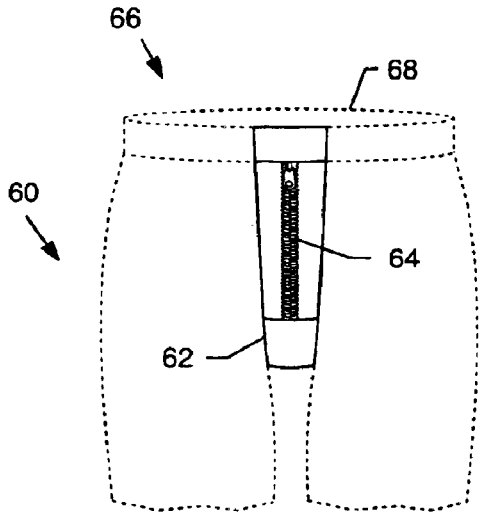
FIG. 13 is a front elevation view of the pants of FIG. 12.

FIGS. 12 and 13 illustrate another embodiment of pants 60 embodying the present invention. The pants 60 are similar, if not substantially identical to the pants 40 described above with respect to FIGS. 1–11. However, in this embodiment, the crotch panel 62 is the form of a single panel construction and the pants closure means 64 is in the form of a zipper located on the front side of the lower torso receiving portion 66. The crotch panel 62 is disposed generally over the area of the external female genitalia and presents a smooth surface that does not follow the contours of the external female genitalia. Alternatively, the crotch panel 62 may extend over the seat of the pants 60 towards a waistband 68 of the pants 60.

The pants closure means 64 is located adjacent to the crotch panel 62 on one end and extends from the crotch panel 62 to the waistband 68 of the pants 60.

Figure 14:
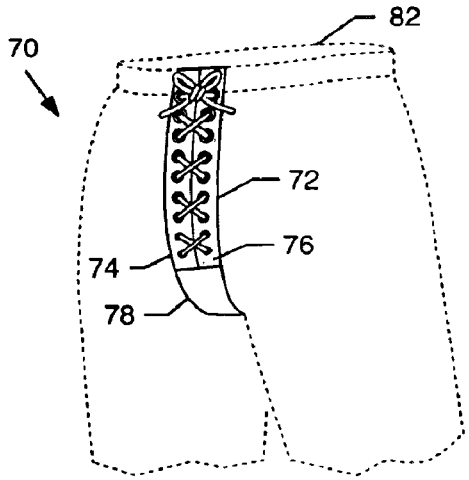
FIG. 14 is an orthogonal view of still another pair of pants embodying the present invention.
Figure 15:
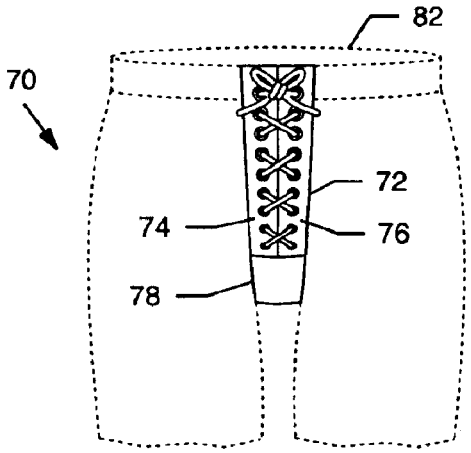
FIG. 15 is a front elevation view of the pants of FIG. 14.
Figure 16:
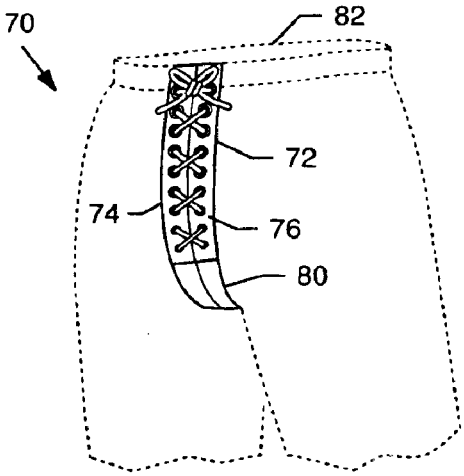
FIG. 16 is an orthogonal view of a yet another pair of pants embodying the present invention.
Figure 17:
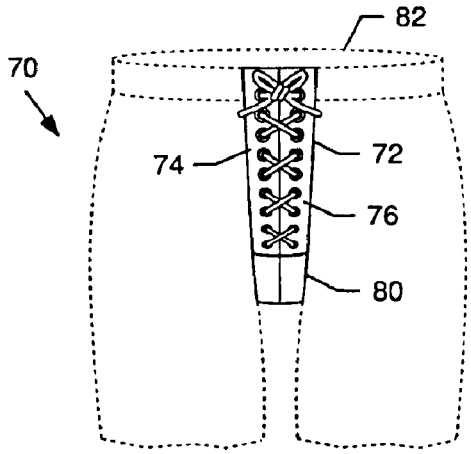
FIG. 17 is a front elevation view of the pants of FIG. 16.

FIGS. 14–17 illustrate two more embodiment of pants 70 embodying the present invention. The embodiments of FIGS. 14–15 and 16–17 are similar to each other in that each includes a pants closure means 72 in the form of a lace-up construction. The closure means 72 also includes two panels 74, 76 extending from the crotch panel 78, 80 to the waistband 82. In either embodiment, the pants closure means 72 is located adjacent to the crotch panel 78, 80 on one end and extends from the crotch panel 78, 80 to the waistband 82. The crotch panels 78, 80 differ in that the crotch panel 78 of FIGS. 14 and 15 is of single panel construction while the crotch panel 80 of FIGS. 16 and 17 is in the form of two panels sewn or otherwise connected together. The crotch panels 78, 80 are disposed generally over the area of the external female genitalia and present a smooth surface that does not follow the contours of the external female genitalia. Alternatively, the crotch panels 78, 80 may extend over the seat of the pants 70 towards the waistband 82 of the pants 70. The embodiments are otherwise similar to the embodiments described above with respect to FIGS. 1–13.

The crotch panels 52, 62, 78, 80 may be padded or non-padded.

The present invention is contemplated for use in conjunction with a variety of women's pant constructions including, denim jeans, leggings, slacks, business suit pants, latex pants, leather pants or the like.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A garment for slimming and smoothing the appearance of a woman's crotch and thighs, comprising:

a pair of pants having a lower torso receiving portion, an upper waistband, two leg portions, an inseam along each leg portion, and a crotch seam between the inseams;

a quadrilaterally-shaped crotch panel comprising two panels sewn together, disposed forward of the crotch seam and between the inseams; and pants closure means extending generally from the crotch panel to the waistband.

2. The garment of claim 1, wherein the closure means comprises a zipper.

3. The garment of claim 1, wherein the closure means comprises a lace-up construction.

4. The garment of claim 1, wherein the closure means includes two panels extending from the crotch panel to the waistband.

5. The garment of claim 1, wherein the waistband includes a closure.

6. The garment of claim 1, wherein at least a portion of the pants is made of a first material and the crotch panel is made of a second material.

7. A garment for slimming and smoothing the appearance of a woman's crotch and thighs, comprising:

a pair of pants having a lower torso receiving portion, two leg portions, an inseam along each leg portion, a crotch seam between the inseams, and an upper waistband including a closure;

a quadrilaterally-shaped crotch panel comprising two panels sewn together, disposed forward of the crotch seam and between the inseams; and pants closure means comprising two panels extending generally from the crotch panel to the waistband.

8. The garment of claim 7, wherein the closure means comprises a zipper.

9. The garment of claim 7, wherein the closure means comprises a lace-up construction.

10. The garment of claim 7 wherein the closure means includes two panels that extend from the crotch panel to the waistband.

11. The garment of claim 7 wherein at least a portion of the pants is made of a first material and the crotch panel is made of a second material.

* * * * *